US009744088B2

(12) United States Patent
Shih

(10) Patent No.: US 9,744,088 B2
(45) Date of Patent: Aug. 29, 2017

(54) ELECTRIC BED

(71) Applicant: Chuan-Hang Shih, Changhua County (TW)

(72) Inventor: Chuan-Hang Shih, Changhua County (TW)

( * ) Notice: Subject to any disclaimer, the term of this patent is extended or adjusted under 35 U.S.C. 154(b) by 90 days.

(21) Appl. No.: 14/590,828

(22) Filed: Jan. 6, 2015

(65) Prior Publication Data

US 2016/0022518 A1 Jan. 28, 2016

(30) Foreign Application Priority Data

Jul. 22, 2014 (TW) ..... 103213089 U

(51) Int. Cl.
*A61G 7/018* (2006.01)
*A61G 7/015* (2006.01)

(52) U.S. Cl.
CPC ..... *A61G 7/018* (2013.01); *A61G 7/015* (2013.01); *A61G 2203/74* (2013.01)

(58) Field of Classification Search
CPC ..... A61G 13/00; A61G 13/02; A61G 13/08; A61G 2203/74; A47C 17/165; A47C 17/1655; A47C 20/04; A47C 20/041; A47C 20/048; A47C 20/08; A47C 20/10; A47C 20/12
See application file for complete search history.

(56) References Cited

U.S. PATENT DOCUMENTS 3,742,527 A * 7/1973 Johnston ..... A61G 7/018 5/429
5,715,548 A * 2/1998 Weismiller ..... A61G 7/002 5/611
6,276,011 B1 * 8/2001 Antinori ..... A47C 20/041 5/613
7,448,100 B1 * 11/2008 Shih ..... A61G 7/015 5/600
2010/0122415 A1 * 5/2010 Turner ..... A61G 7/015 5/618
2010/0325799 A1 * 12/2010 Huang ..... A47C 20/041 5/616
2011/0094032 A1 * 4/2011 Shih ..... A47C 20/041 5/614
2012/0159712 A1 * 6/2012 Lee ..... A61G 7/015 5/613

(Continued)

*Primary Examiner* — Nicholas Polito
*Assistant Examiner* — Amanda L Miller
(74) *Attorney, Agent, or Firm* — Muncy, Geissler, Olds & Lowe, P.C.

(57) ABSTRACT

An electric bed includes a base frame, a movable frame slidably disposed on the base frame and moveable backward and forward, a back frame having a rear end pivotally connected with the movable frame, and a driving member extendable and retractable in length, having a rear end pivotally connected with the movable frame and located below the rear end of the back frame, and a front end pivotally connected with the back frame. A linkage has a front end pivotally connected with the base frame, and a rear end pivotally connected with the back frame and located between the rear end of the back frame and the front end of the driving member. When the driving member extends longer, the back frame is rotated upwardly to enable the rear end of the back frame and the movable frame to horizontally move forward together.

3 Claims, 6 Drawing Sheets

(56) References Cited

U.S. PATENT DOCUMENTS

| | | | | |
|---|---|---|---|---|
| 2014/0041121 | A1* | 2/2014 | Shan | A47C 21/006 5/618 |
| 2015/0305510 | A1* | 10/2015 | Tarplee | A47C 20/041 601/57 |

* cited by examiner

ELECTRIC BED

BACKGROUND

1. Technical Field

The present disclosure relates to a bed, in particular to an electric bed capable of improving the comfort and convenience in usage.

2. Description of Related Art

In many traditional electric beds, a back frame used to lean against a user's back is provided with function of being rotated upwardly, and the user can adjust the inclined angle of the back frame upon demand for the changing between a lying posture and a sitting posture. However, the back frame of the traditional electric bed is pivotally connected with a hip support which bears buttocks of the user. When the back frame is lifted up, the user may feel the abdomen being pressed and uncomfortable because the distance between the user's buttocks and the back frame becomes shorter correspondingly. In such situation, the user has to move the buttocks toward the foot portion of the electric bed for feeling comfortable. In addition, it is inconvenient for user to take or put an object due to the longer distance between the back frame lifted and the nightstand. On the other hand, after the back frame is returned to the horizontal position, the user must move the buttocks toward the bed head for enabling the body to return to the original lying position. Therefore, what is need is to improve the convenience in usage of the traditional electric bed, particularly, for the user who has difficulty in moving, a pregnant woman or a fatter user.

SUMMARY

An exemplary embodiment of the present disclosure provides an electric bed capable of improving comfort and convenience in usage.

According to one exemplary embodiment of the present disclosure, the electric bed of the present disclosure includes a base frame, a movable frame, a back frame, at least one linkage and a driving member. The movable frame is slidably disposed on the base frame and movable on the base frame backward and forward. The back frame is pivotally connected with the movable frame at a rear end thereof. The linkage has a front end pivotally connected with the base frame, and a rear end pivotally connected with the back frame. The driving member has a rear end pivotally connected with the movable frame, and a front end pivotally connected with the back frame. The rear end of the driving member is located below the rear end of the back frame. The driving member has a first unit and a second unit. The first unit is one of a cylinder and an actuation rod, and the second unit is the other of the cylinder and the actuation rod. The actuation rod is held within the cylinder and can be protruded from or retracted to the cylinder to enable the driving member to become longer or shorter. The rear end of the at least one linkage is located between the rear end of the back frame and the front end of the driving member, such that the back frame is rotated upwardly and the movable frame is moved forward at the same time when the driving member becomes longer. The back frame is rotated downwardly and the movable frame is moved backward at the same time when the driving member becomes shorter.

To sum up, when the back frame is rotated upwardly, the rear end of the back frame is horizontally moved toward the bed head at the same time, so the user can relieve the pressure and discomfort on the abdomen while changing from the lying posture to the sitting posture, and it is also convenient for the user to take or put an object on the nightstand at the sitting posture.

In order to further understand the techniques, means and effects of the present disclosure, the following detailed descriptions and appended drawings are hereby referred, such that, through which, the purposes, features and aspects of the present disclosure can be thoroughly and concretely appreciated; however, the appended drawings are merely provided for reference and illustration, without any intention to be used for limiting the present disclosure.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DESCRIPTION OF THE EXEMPLARY EMBODIMENTS

Figure 1:
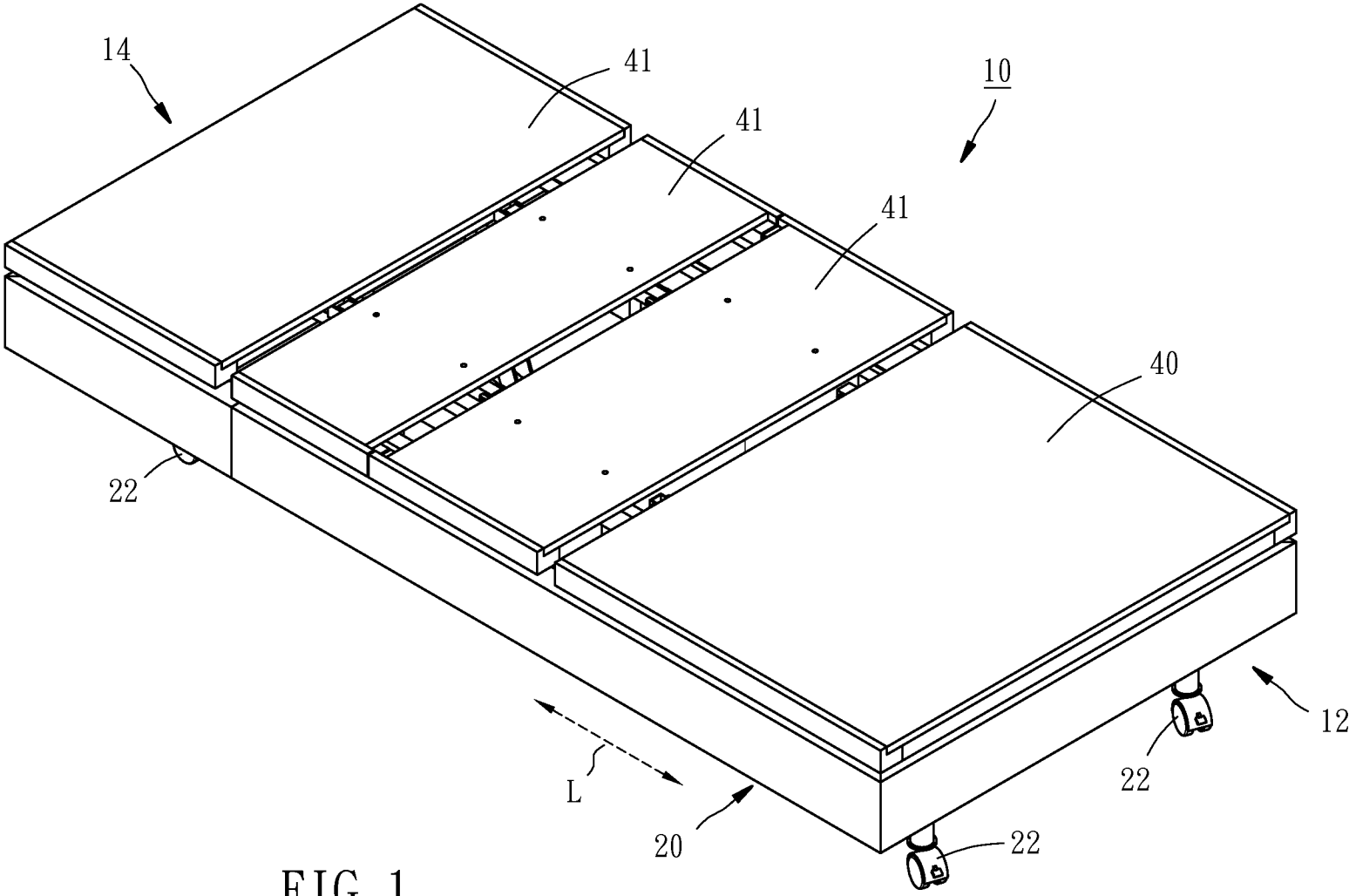
FIG. 1 is a perspective view of a first preferred embodiment of the present disclosure.

Reference will now be made in detail to the exemplary embodiments of the present disclosure, examples of which are illustrated in the accompanying drawings. Wherever possible, the same reference numbers are used in the drawings and the description to refer to the same or like parts.

Figure 3:
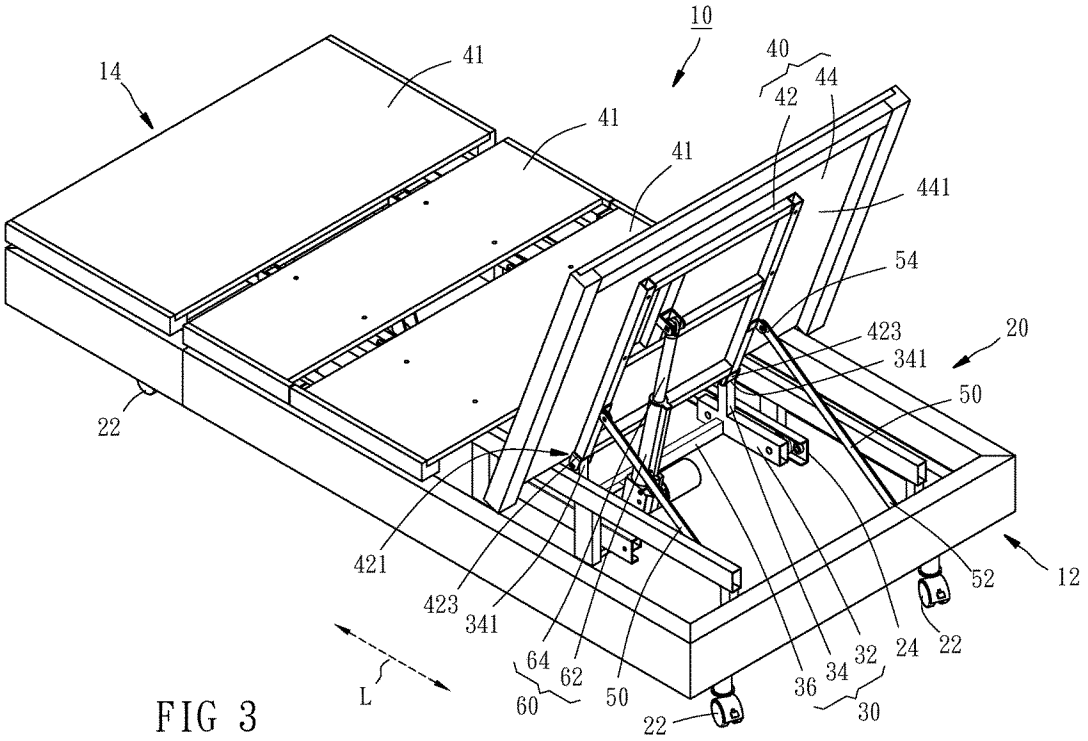
FIG. 3 is a schematic perspective view showing the action of a first preferred embodiment of the present disclosure.

Please refer to FIG. 1 and FIG. 3 which show an electric bed 10 provided by a first preferred embodiment of the present disclosure. The electric bed 10 includes a base frame 20, a movable frame 30, a back frame 40, two linkages 50 and a driving member 60. In the following embodiment illustration of the present disclosure, the head portion of electric bed 10 is defined at the front direction 12, and a foot portion is defined at the back direction 14, and the longitudinal portion of the electric bed 10 is defined at the longitudinal direction L. Further, in the present disclosure and appendix claims, if an element is defined to be moved backward or forward, it means the element is moved toward the foot portion or head portion of the electric bed.

Figure 6:
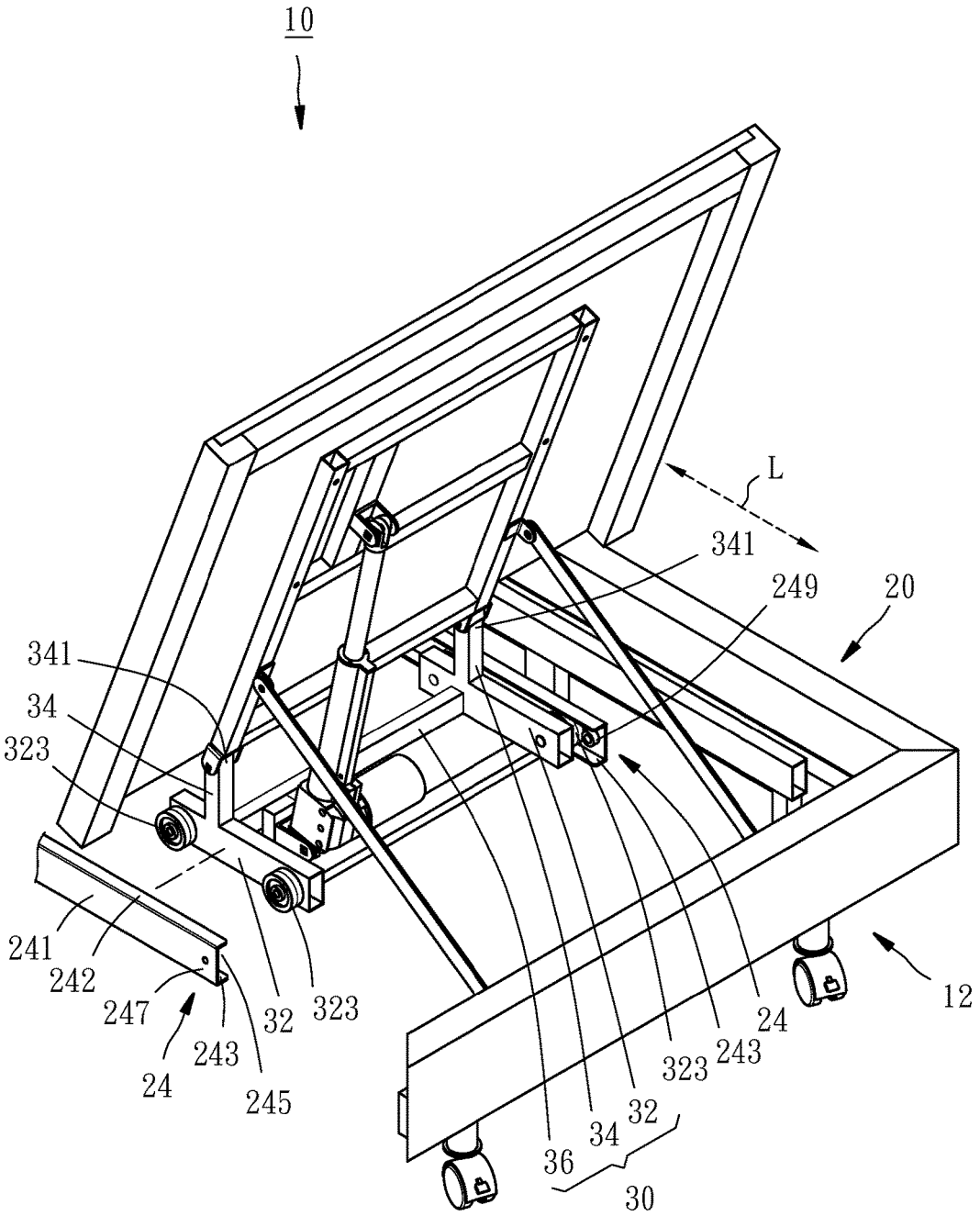
FIG. 6 is a partially exploded view of a bed head portion of the first preferred embodiment of the present disclosure.

The base frame 20 is a substantially rectangular frame formed by assembly of multiple rods, and has four casters 22 disposed thereunder for convenient movement. The base frame 20 is used for supporting the back frame 40 and other bed plates 41. As shown in FIG. 6, the base frame 20 further has two slide rails 24 extending along the longitudinal direction L, and each slide rail 24 has a side plate 241, a top plate 242 and a bottom plate 243. The top plate 242 and bottom plate 243 are integrally formed with and horizontally extended from a top end and a bottom end of the side plate 241, respectively, such that an accommodating space 245 is formed between the side plate 241, the top plate 242 and the bottom plate 243. In addition, each slide rail 24 is provided with a stop member 249 disposed at a front end 247 of the side plate 241.

The movable frame 30 is slidably disposed on the base frame 20 and has two longitudinal rods 32, two upright rods 34 and a transverse rod 36. As shown in FIG. 6, the positions of the two longitudinal rods 32 correspond to the two slide rails 24. Each upright rod 34 is formed with and extended from respective longitudinal rod 32 upwardly and has a top end 341. Two ends of the transverse rod 36 are fixedly mounted on the two longitudinal rods 32, respectively. Two rollers 323 are respectively disposed on the outer sides of the two longitudinal rods 32 opposite to each other, and contact the bottom plates 243 of the slide rails 24 within the accommodating spaces 245, respectively, such that the movable frame 30 is movable relatively to the base frame 20 along the longitudinal direction L, i.e. moveable backward and forward, by means of the rolling of the rollers 323 in the slide rails 24.

The structure of the movable frame 30 is not limited to the content of the embodiment and can be changed upon demand. The connecting way between the movable frame 30 and the base frame 20 can also be changed. For example, the roller 323 can be replaced by a rotating member such as a ball bearing, or a sliding member such as a slider, so long as the movable frame 30 can be slidably disposed on the base frame 20 and moveable backward and forward. In addition, the number of the rollers 323 can also be changed upon demand.

The back frame 40 includes a support frame 42 and a support plate 44. The support frame 42 is mounted on the bottom 441 of the support plate 44, as shown in FIG. 3. The support frame 42 has two pivot parts 423 disposed at a rear end 421 thereof and being pivotally connected with the top ends 341 of the two upright rods 34 of the movable frame 30, respectively. In other embodiment, the back frame 40 can only have the support frame 42 without the support plate 44. The structure of the back frame 40 can be changed, so long as the rear end 421 of the back frame 40 can be pivotally connected with the movable frame 30. The pivotally connecting position is not limited to the top ends 341 of the movable frame 30.

Figure 2:
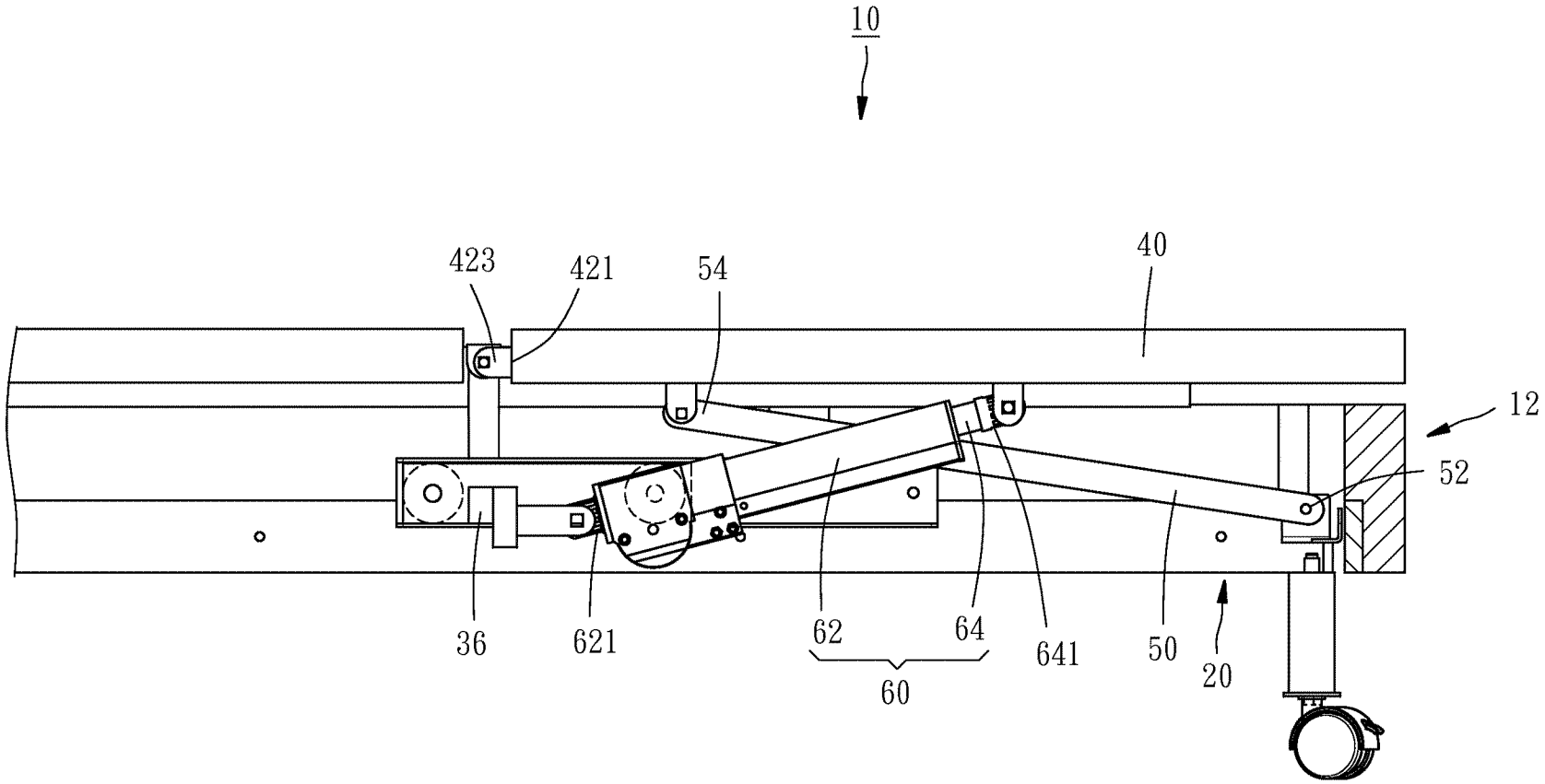
FIG. 2 is a partial lateral view of the first preferred embodiment of the present disclosure.

The front ends 52 of two linkages 50 are pivotally connected with the base frame 20, and the rear ends 54 of the two linkages 50 are pivotally connected with the support frame 42 of the back frame 40, as shown in FIG. 2 and FIG. 3. In other embodiment, the electric bed of the present disclosure may comprises one or more linkages 50, and the rear end 54 of the linkage 50 can be pivotally connected with the support plate 44 of the back frame 40.

The driving member 60 has a first unit and a second unit. The first unit is one of a cylinder and an actuation rod, and the second unit is the other of the cylinder and the actuation rod. In this embodiment, the first unit is the cylinder 62 and the second unit is the actuation rod 64, as shown in FIG. 2. The actuation rod 64 is held within the cylinder 62 and can be protruded outwardly from the cylinder 62 toward the front direction 12 and retracted back to the cylinder 62, such that the length of the driving member 60 can become longer or shorter. A front end 641 of the driving member 60, namely the front end of the actuation rod 64, is pivotally connected with the support frame 42 of the back frame 40, and a rear end 621 of the driving member 60, namely the rear end of the cylinder 62, is pivotally connected with the transverse rod 36 of the movable frame 30. The rear end 621 of the driving member 60 may be pivotally connected with other part of the movable frame 30, so long as the rear end 621 of the driving member 60 is positioned blow the rear end 421 of the back frame 40. In addition, positions of the cylinder 62 and the actuation rod 64 of the driving member 60 can be exchanged. This means that the actuation rod 64 is configured to be outwardly protruded from the cylinder 62 toward the back direction 14 and returned to the cylinder 62. In this case, the front end 641 of the driving member 60, namely the front end of the cylinder 62, is pivotally connected with the back frame 40, and the rear end 621 of the driving member 60, namely the rear end of the actuation rod 64, is pivotally connected with the movable frame 30. In other embodiment, the front end 641 of the driving member 60 can be pivotally mounted on the support plate 44 of the back frame 40 directly.

Figure 4:
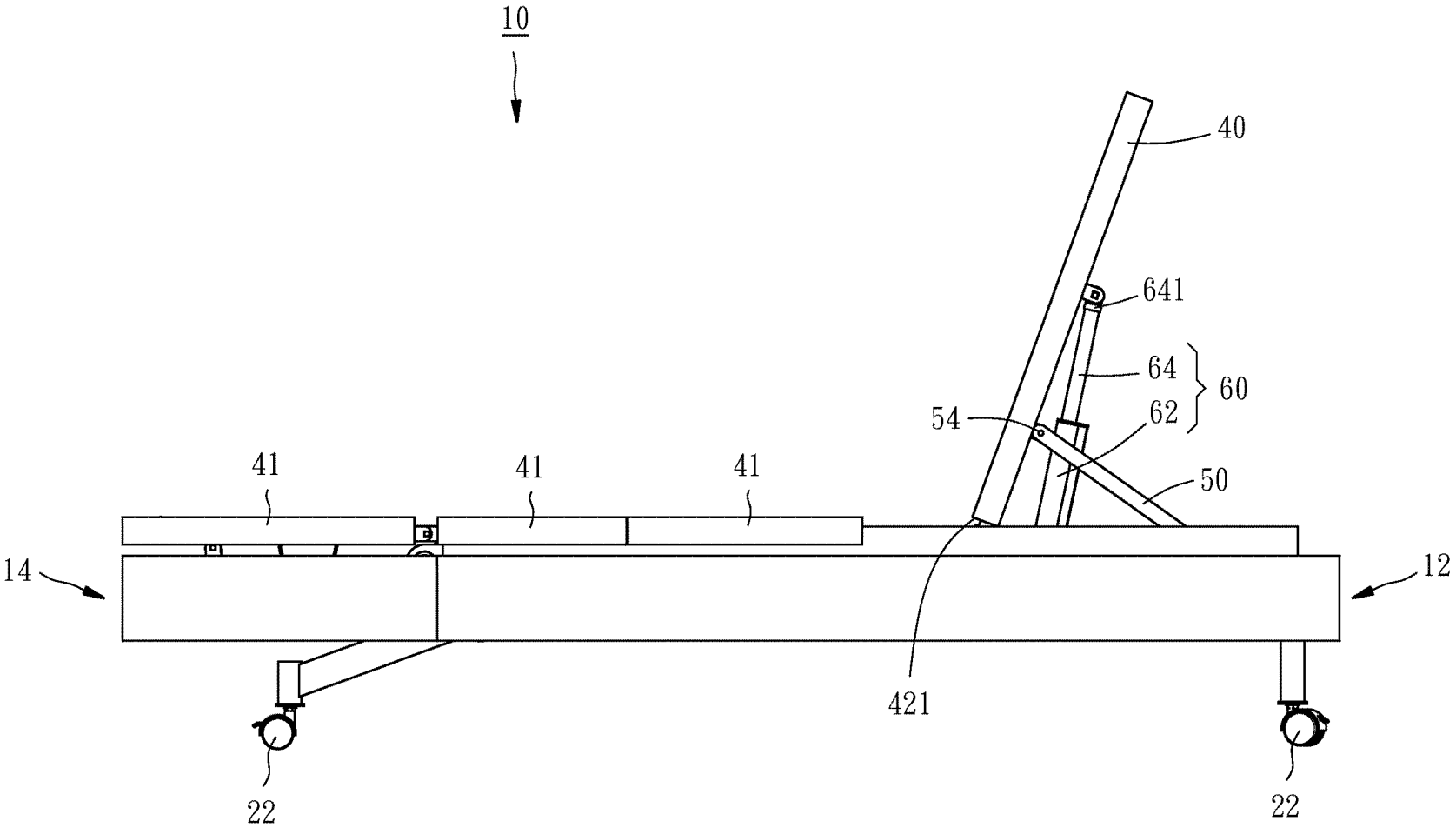
FIG. 4 is a schematic lateral view showing the action of the first preferred embodiment of the present disclosure.
Figure 5:
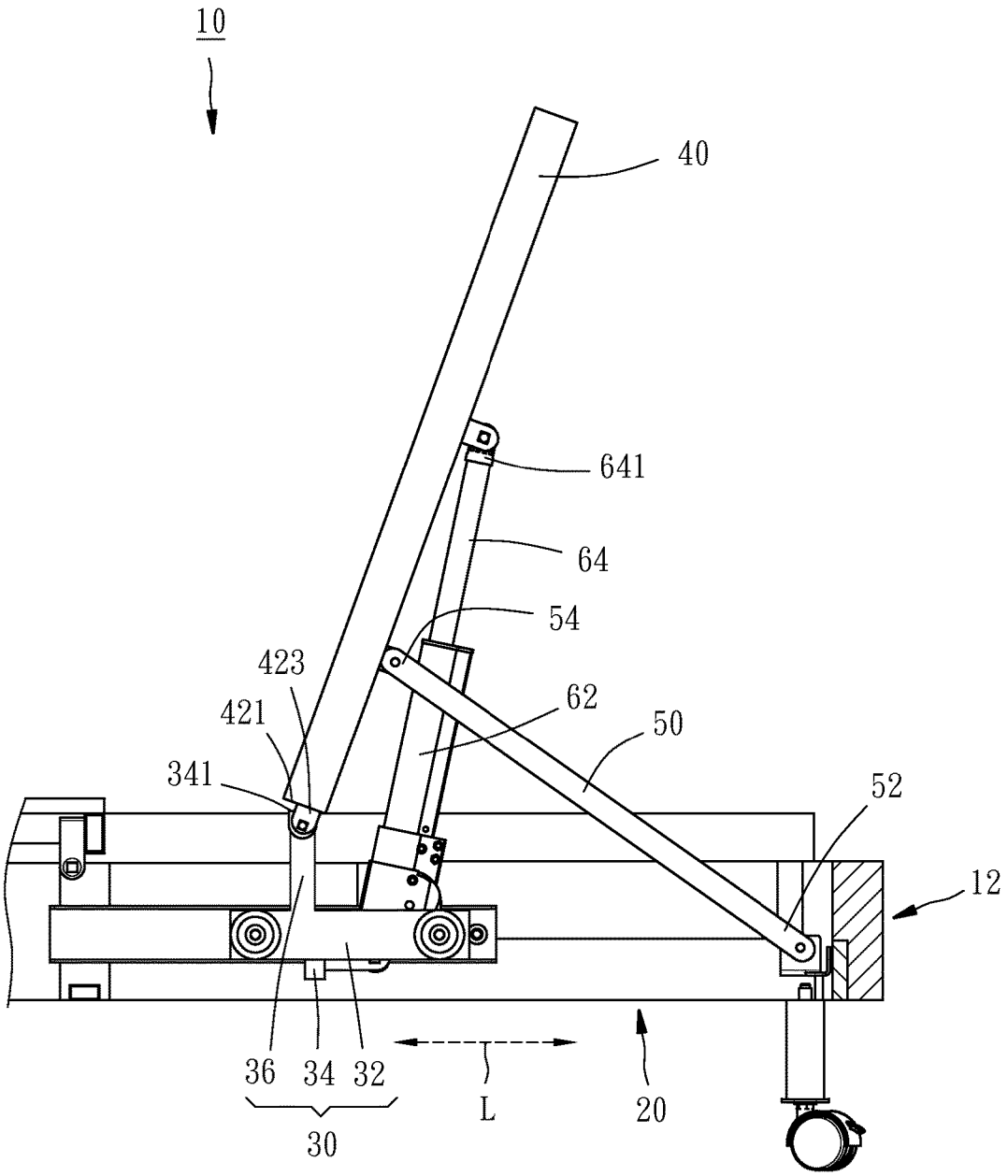
FIG. 5 is a partially cutaway lateral view showing the action of the first preferred embodiment of the present disclosure.

In addition, in viewing direction of the FIG. 2, FIG. 4 and FIG. 5, the rear end 54 of the linkage 50 is located between the rear end 421 of the back frame 40 and the front end 641 of the driving member 60, i.e., the pivotally connecting position between the linkage 50 and the back frame 40 is located in front of the pivotally connecting position between the movable frame 30 and the back frame 40, i.e. pivot part 423, and behind the pivotally connecting position between the driving member 60 and the back frame 40.

When the electric bed 10 is not operated and the back frame 40 stays at a horizontal status, the actuation rod 64 is received in the cylinder 62, as shown in FIG. 2. When the actuation rod 64 is protruded outwardly toward the front direction 12 from the cylinder 62, as shown in FIG. 3 through the FIG. 6, the back frame 40 is driven to rotate upwardly about the pivot parts 423. During the upward rotation of the back frame 40, because the back frame 40 is connected with and restricted by the linkages 50, the rear end 421 of the back frame 40 and the movable frame 30 are horizontally moved toward the front direction 12 together, i.e. moved forward. The movable frame 30 keeps sliding forward until the front rollers 323 contact the stop members 249, respectively, such that a slidable range of the movable frame is limited. Reversely, when the actuation rod 64 is retracted back to the cylinder 62, the back frame 40 is driven to rotate downwardly about the pivot parts 423, and because the back frame 40 is restricted by the linkages 50, the rear end 421 of the back frame 40 and the movable frame 30 are horizontally moved toward the back direction 14 together, i.e. moved backward, until the back frame 40 restores to the horizontal status in the original, as shown in FIG. 2.

In other embodiment, the stop members 249 can be omitted, and when the actuation rod 64 of the driving member 60 is extended to its limitation, the back frame 40 is not driven by the driving member 60 anymore and is stopped rotating upwardly, so the movable frame 30 can be stopped sliding forward.

Therefore, when the driving member 60 becomes longer, the back frame 40 is rotated upwardly to enable the movable frame 30 to move toward the front direction 12 at the same time, whereby the distance between buttocks of a user and the back frame 40 becomes longer than the traditional electric bed while the user changes from a lying posture to a sitting posture, and the user can relieve the pressure and discomfort on the abdomen without moving his or her buttocks toward the back direction 14, and it is convenient for the user to take or put an object on the nightstand at sitting posture. When the driving member 60 becomes shorter, the back frame 40 is rotated downwardly to enable the movable frame 30 to move toward the back direction 14 at the same time, whereby the user does not need to shift forward, such that the electric bed 10 of the present disclosure can efficiently improve the comfort and convenience in usage.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. An electric bed, comprising:

a base frame;

a movable frame slidably disposed on the base frame and movable on the base frame backward and forward;

a back frame pivotally connected with the movable frame at a rear end thereof;

at least one linkage having a front end pivotally connected with the base frame, and a rear end pivotally connected with the back frame; and a driving member having a rear end pivotally connected with the movable frame, and a front end pivotally connected with the back frame, the rear end of the driving member being located below the rear end of the back frame, the driving member having a first unit and a second unit, the first unit being one of a cylinder and an actuation rod, and the second unit being the other of the cylinder and the actuation rod, the actuation rod being held within the cylinder and protrudable from or retractable to the cylinder to enable a length of the driving member to become longer or shorter;

wherein the base frame supports the back frame and a plurality of bed plates, wherein the rear end of the at least one linkage is located between the rear end of the back frame and the front end of the driving member, such that the back frame is rotated upwardly and the movable frame is moved forward relative to the bed plates when the driving member becomes longer, and the back frame is rotated downwardly and the movable frame is moved backward relative to the bed plates when the driving member become shorter, and wherein the bed plates remain in the same position during the rotations of the back frame upwardly or downwardly.

2. The electric bed according to claim 1, wherein the base frame has two slide rails extending along a longitudinal direction of the electric bed, and the movable frame is provided at two sides thereof with a plurality of rollers runnable in the two slide rails, respectively.

3. The electric bed according to claim 1, wherein the rear end of the back frame is pivotally connected with a top end of the movable frame.

* * * * *